US012485309B1

(12) United States Patent
Lv

(10) Patent No.: US 12,485,309 B1
(45) Date of Patent: Dec. 2, 2025

(54) FOREARM EXERCISER

(71) Applicant: Zejie Lv, Jinhua (CN)

(72) Inventor: Zejie Lv, Jinhua (CN)

( * ) Notice: Subject to any disclaimer, the term of this patent is extended or adjusted under 35 U.S.C. 154(b) by 0 days.

(21) Appl. No.: 19/201,955

(22) Filed: May 8, 2025

(51) Int. Cl.
*A63B 23/12* (2006.01)
*A63B 21/00* (2006.01)

(52) U.S. Cl.
CPC ..... *A63B 23/12* (2013.01); *A63B 21/4035* (2015.10)

(58) Field of Classification Search
CPC ..... A63B 21/072; A63B 21/0724; A63B 21/0726; A63B 21/0722; A63B 21/4035; A63B 23/129; A63B 23/14
See application file for complete search history.

(56) References Cited

U.S. PATENT DOCUMENTS 2,475,656 A * 7/1949 Bidak ..... A63B 23/14 D21/680
5,380,261 A * 1/1995 Mora ..... A63B 21/153 482/109
6,099,437 A * 8/2000 DeMers ..... A63B 21/153 482/46
D930,765 S * 9/2021 Ehtesham ..... D21/684
2002/0137599 A1* 9/2002 Kuo ..... A63B 23/14 482/45
2007/0167298 A1* 7/2007 Bystrom ..... A63B 23/14 482/45
2012/0245004 A1* 9/2012 Bremer ..... A63B 23/14 482/129
2023/0201653 A1* 6/2023 Drumheller ..... A63B 21/068 482/145
2024/0261631 A1* 8/2024 Shechter ..... A63B 21/4035
2024/0299800 A1* 9/2024 Bardunias ..... A63B 23/1281

* cited by examiner

*Primary Examiner* — Joshua T Kennedy
(74) *Attorney, Agent, or Firm* — Jose Cherson Weissbrot

(57) ABSTRACT

A forearm exerciser is provided, including an exerciser body, wherein the exerciser body is of a cylindrical structure and includes a winding portion in the middle and grip portions symmetrically arranged at both ends of the winding portion. A suspension rope is connected to the winding portion, and an inner ring for allowing the rod body to pass through is formed at a central axis of the exerciser body, so as to ensure the training effect of the forearm and ensure the safe training of a trainee.

9 Claims, 5 Drawing Sheets

FOREARM EXERCISER

TECHNICAL FIELD

The present invention relates to the technical field of fitness training equipment, and more particularly to a forearm exerciser.

BACKGROUND ART

As a special strength training for forearm muscles, forearm training is an important part of upper limb strength training, aiming to improve grip strength, wrist stability and forearm endurance; existing trainees typically use a steel tube with a rope to suspend the counterweight so that they can lift the weight by holding the steel tube, rotating and winding the rope. This training method mainly uses the shoulders and arms to resist the weight of steel tubes and counterweights, thereby stimulating the arm muscles to achieve the training goal. The wrist strength is also exercised by alternately griping and rotating steel tubes with both hands, thereby fully activating the forearm muscles.

However, due to the limited strength of the shoulder and arm of the trainee, the long-term lifting of the steel tube and counterweight can easily lead to out-of-control action, weight swaying and slipping, which not only affects the training effect, but also causes the safety hidden dangers by the sudden release of hands. In addition, when rotating the steel pipe and winding the rope, the position of the rope tends to shift when winding and lifting counterweight due to the unsecured winding position, which results in the training intensity deviation of both arms, and the trainee tends to suffer from strain due to the excessive weight of one arm caused by the shift.

SUMMARY OF THE INVENTION

In order to solve the above-mentioned problems of the background art, the present invention provides a forearm exerciser, which can be fixed to a rod body for auxiliary training, and can improve the training effect and reduce the occurrence of a strain condition.

The solution taken by the present invention to solve the technical problem thereof is: a forearm exerciser including an exerciser body, wherein the exerciser body is of a cylindrical structure and includes a winding portion circumferentially arranged in the middle of the exerciser body and grip portions symmetrically arranged at both ends of the winding portion for gripping during exercise, a suspension rope for suspending a weight is connected to the winding portion, and an inner ring for allowing a rod body to pass through is formed at a central axis of the exerciser body.

Further, an outer diameter of the winding portion is smaller than an outer diameter of the grip portion and sinks to form a winding groove for winding the suspension rope.

Further, the winding portion is provided with a connection port where a connection post arranged in a width direction of the winding portion is mounted, and an end of the suspension rope is connected to the connection post.

Further, the other end of the suspension rope connected to the connection post is provided with a connection clasp for clasping to a hook for exercising.

Further, a width of the grip portion is greater than a width of the winding portion, and a surface of the grip portion is provided with an anti-slip pattern.

Further, the exerciser body is divided into a first body and a second body formed in a semi-circular structure along a plane of its central axis, one side edge of the first body and one side edge of the second body are hinged to each other, and a pull clasp assembly is connected between the other side edge of the first body and the other side edge of the second body.

Further, the pull clasp assembly includes a clasp member hinged to an edge of the first body and a pull rod member hinged to an edge of the second body, the clasp member is provided with a clasp opening, the other end of the pull rod member hinged to the second body being hinged in the clasp opening, wherein the first body and the second body are closed around the rod body when the clasp member is pressed to pull the pull rod member.

Further, the first body or the second body is provided with a storage port for receiving the pull clasp assembly at a position corresponding to the winding portion.

Further, a wall surface of the inner ring of the exerciser body is provided with an anti-slip pad.

Further, the wall surface of the inner ring of the exerciser body is provided with a limit mounting groove, the anti-slip pad is embedded in the limit mounting groove, and a top of the anti-slip pad is higher than the wall surface of the inner ring of the exerciser body.

In view of the above, the present invention has the following advantageous effects.

1. In the present invention, by providing an exerciser body with a cylindrical structure and an inner ring at a central axis, and providing a winding portion connected with a suspension rope in the middle of the circumferential direction of the exerciser body, the exerciser body can be mounted on a rod body via the inner ring when a trainee trains, thereby reducing the use of a shoulder and an upper arm strength by the exerciser body and facilitating the improvement of the training effect of a forearm; in addition, in the process of winding the suspension rope through the exerciser body, the suspension rope can be stably wound on the winding portion in the middle of the circumferential direction of the exerciser body, so that the winding of the suspension rope can be prevented from being shifted, and thus the training intensity of the two arms can be prevented from being deviated to cause strain.
2. In the present invention, by providing grip portions on both sides of the winding portion, the trainee can not only grip on the rod for more grip training, but also grip on the grip portion when rotating the winding weight, thereby obtaining a better frictional force and thus preventing a slipping injury.

The above description is only an overview of the technical solution of the present invention. In order to have a clearer understanding of the technical means of the present invention, it can be implemented according to the content of the specification. In order to make the above and other objectives, features, and advantages of the present invention more obvious and understandable, the following preferred embodiments are given in detail with the accompanying drawings.

Figure 1:
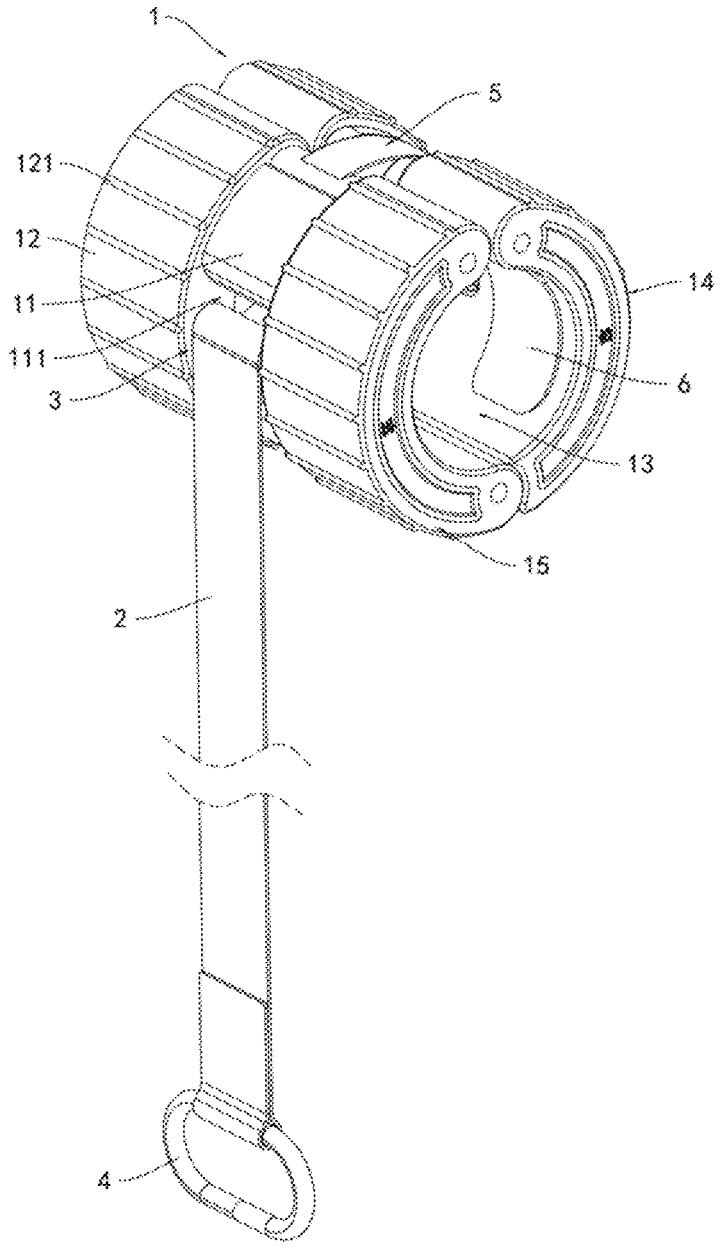
FIG. 1 is a structure schematic view of an exerciser body according to the present embodiment.

In the drawings: 1. exerciser body; 11. winding portion; 111. connection port; 112. connection post; 12. grip portion; 121. anti-slip pattern; 13. inner ring; 131. limit mounting groove; 14. first body; 15. second body; 16. storage port; 2. suspension rope; 3. winding groove; 4. connection clasp; 5. pull clasp assembly; 51. clasp member; 511. clasp opening; 52. pull rod member; 6. anti-slip pad; 7. rod body.

DETAILED DESCRIPTION OF THE INVENTION

In order that the present invention may be more readily understood, a more particular description of the disclosure will be rendered by reference to specific embodiments thereof, which are illustrated in the appended drawings.

It should be noted that the terms "central", "upper", "lower", "front", "back", "left", "right", "inner", "outer", and the like, as used herein, indicate orientations or positional relationships based on the orientation or positional relationships shown in the figures, are merely for ease of description of the present invention and simplicity of description, and do not indicate or imply that the referenced devices or elements must have a particular orientation, be constructed and operated in a particular orientation, and thus should not be construed as limiting the present invention. Unless otherwise indicated, the meaning of "a plurality" is two or more.

Unless expressly specified or limited otherwise, the terms "mounted", "communicate", and "connected" are to be interpreted broadly, and may be, for example, fixedly connected, detachably connected, or integrally connected; can be mechanically or electrically connected; they may be connected directly or indirectly through intervening media, or they may be interconnected between two elements. The specific meaning of the above terms in the present invention can be understood by those skilled in the art according to specific circumstances.

Figure 2:
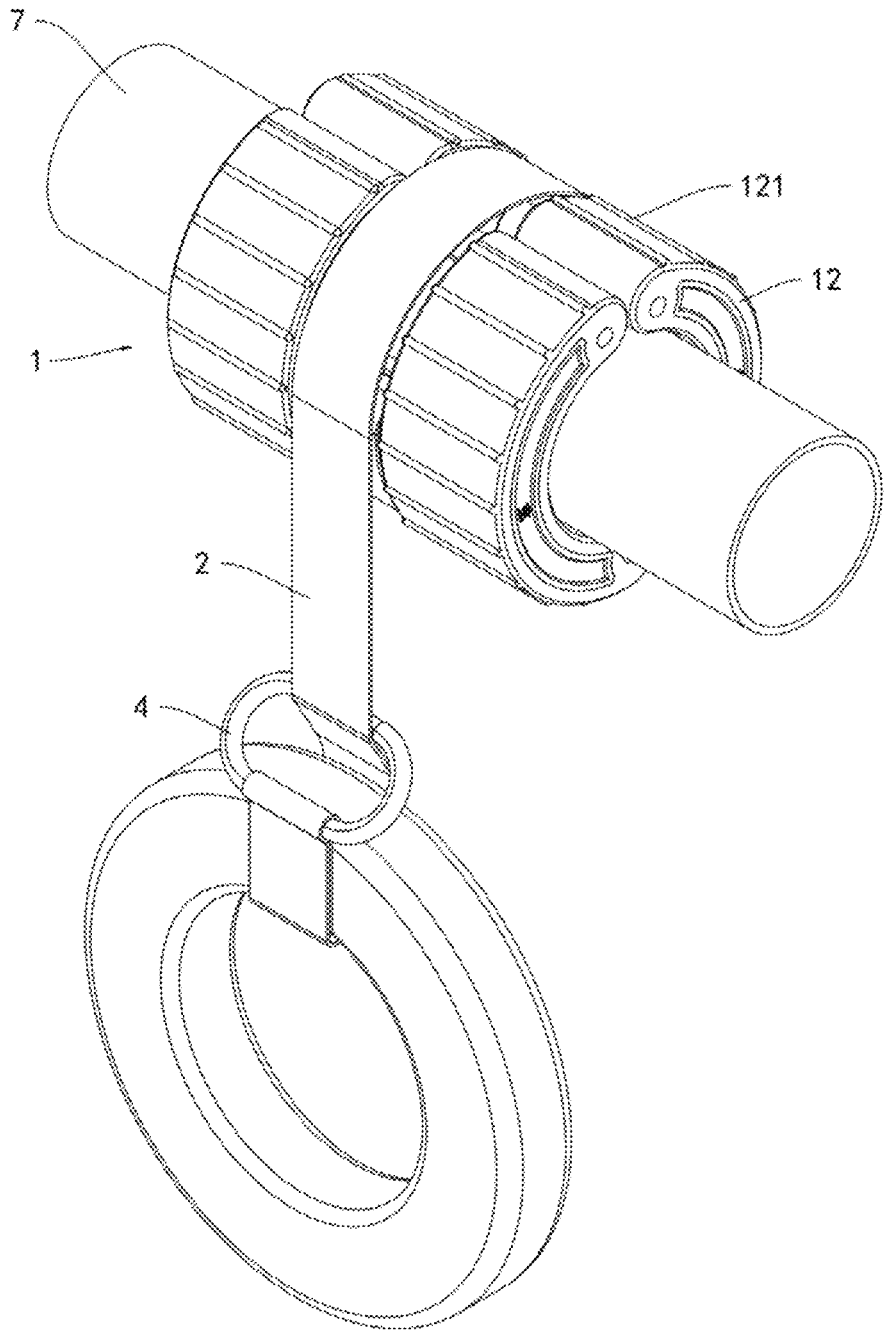
FIG. 2 is a structure schematic view of the exerciser body in use according to the present embodiment.

As shown in FIG. 1 to FIG. 2, a forearm exerciser includes an exerciser body 1 which can be fixed on a rod body 7, and when training a forearm, a trainee can suspend a counterweight by means of the exerciser body 1 to perform auxiliary training, so that the training effect of the forearm and the wrist can be improved, and shifting, slipping and the like during the training can be avoided to ensure the safety of training. The exerciser body 1 of the present embodiment is of a cylindrical structure, particularly a cylinder, wherein an inner ring 13 is provided at the position of the central axis of the exerciser body 1, and the structure of the inner ring 13 is adapted to the structure of the rod body 7, so that the exerciser body 1 of the present embodiment can be sheathed onto the rod body 7 via the inner ring 13, so that a trainee can perform auxiliary training via the exerciser body 1 of the present embodiment when performing forearm training via the rod body 7, thereby improving the training effect and avoiding injury.

As shown in FIG. 1, the outer wall of the exerciser body 1 of the present embodiment is provided with a winding portion 11 circumferentially arranged around the exerciser body 1, wherein a suspension rope 2 is connected to the winding portion 11, so that when the trainee performs training, a counterweight can be connected via the suspension rope 2, thereby improving the training strength. In addition, the winding portion 11 of the present embodiment is arranged at the middle of the exerciser body 1, namely, the suspension rope 2 is connected to the middle position of the exerciser body 1, so that the position of the center of gravity of the exerciser body 1 of the present embodiment can be located at the center of the exerciser body 1 after the counterweight is suspended, so that the two sides of the exerciser body 1 can be balanced, and thus the consistency of double-arm training can be ensured.

Figure 3:
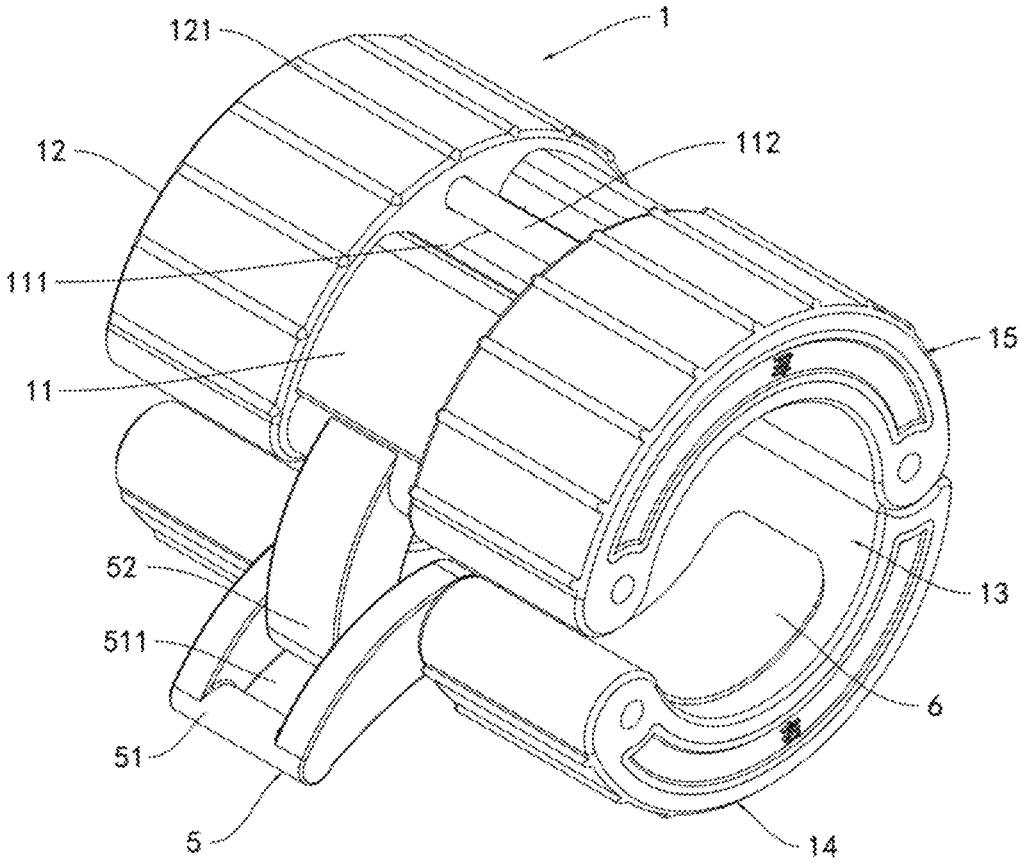
FIG. 3 is a structure schematic view of a clasp assembly of the present embodiment when it is not closed.

In addition, the exerciser body 1 according to the present embodiment further includes a grip portion 12 symmetrically provided at both ends of the winding portion 11, wherein the grip portion 12 can be gripped by the trainee during training, so as to avoid the slipping caused by sweating of the palm during training and improve the safety during training; in addition, the trainee can perform training directly through the grip portion 12 without mounting the exerciser body 1 on the rod body 7, thereby reducing the use of the shoulder and the upper arm strength and facilitating the improvement of the training effect of the forearm. As shown in FIG. 1 to FIG. 3, the width of the grip portion 12 of the present embodiment is greater than the width of the winding portion 11, so that a trainee can grip the grip portion 12 during the training process and improve the hand feeling during the training. In addition, the surface of the grip portion 12 of the present embodiment is further provided with an anti-slip pattern 121, so that the anti-slip pattern 121 can increase the friction force with the palm of the trainee during the training process when the trainee grips the grip portion 12, thereby preventing hand slippage and detachment during the training process of winding up the counterweight, thus ensuring the safety of the training.

Figure 4:
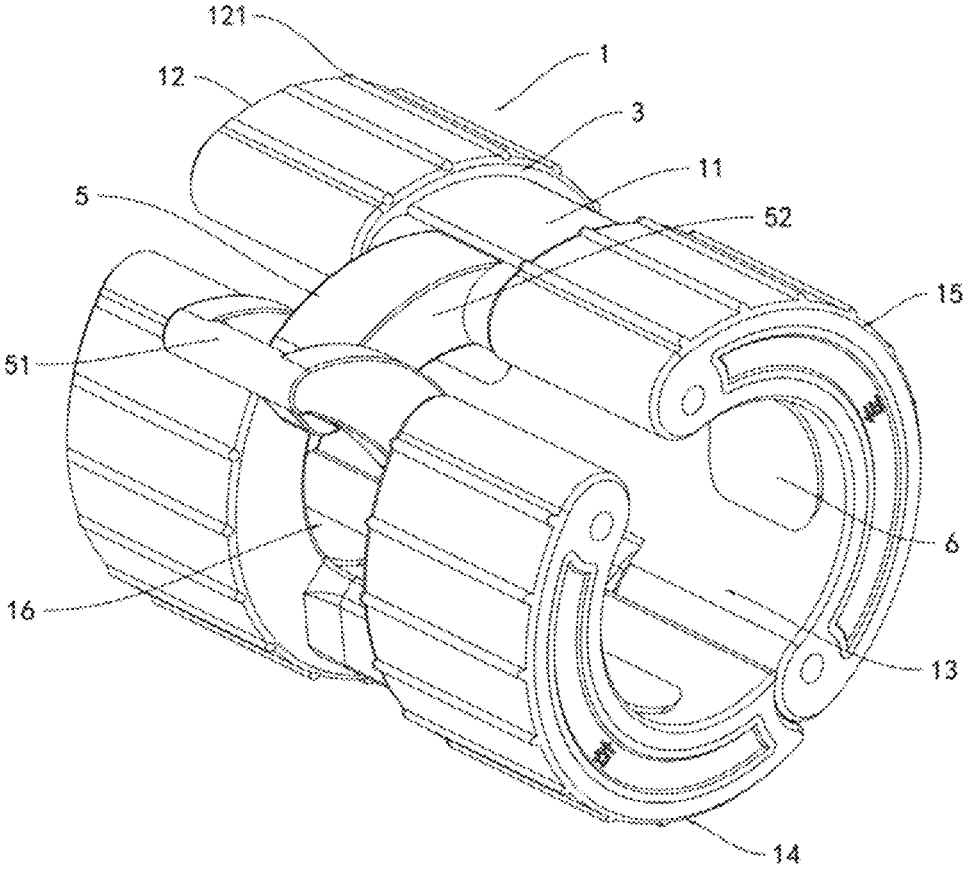
FIG. 4 is a structure schematic view of another angle of the clasp assembly of the present embodiment when it is not closed.

As shown in FIG. 1, FIG. 3 and FIG. 4, the outer diameter of the winding portion 11 in the present embodiment is smaller than the outer diameter of the grip portion 12, that is to say, the winding portion 11 sinks down and is combined with the grip portions 12 on both sides to form a winding groove 3, and one end of the suspension rope 2 is connected to the winding portion 11 and is located in the winding groove 3, so that when a trainee grips the rod body 7 to rotate so as to wind the suspension rope 2 for training, the suspension rope 2 can be wound in the winding groove 3 driven by the rod body 7, so that it can avoid the suspension rope 2 shifting during the winding process from affecting the balance on both sides of the exerciser body 1, which not only ensures the training effect; it also avoids the occurrence of safety hazards, such as out-of-control action and weight swaying caused by the shifting of the suspension rope 2.

Further, as shown in FIG. 1 and FIG. 3, the winding portion 11 of the present embodiment is provided with a connection port 111 provided along the width direction thereof, and a connection post 112 is mounted in the connection port 111, and one end of the suspension rope 2 of the present embodiment is connected to the connection post 112, so that it is convenient for the trainee to hang the counterweight by the suspension rope 2 during training to improve the training strength. In addition, the connection post 112 of the present embodiment is provided along the width direction of the winding portion 11, and the suspension rope 2 is adapted to the width of the winding portion 11, so that after the suspension rope 2 is connected, the suspension rope 2 can be just fitted into the winding groove 3 formed by the combination of the winding portion 11 and the grip portion 12, so that when the trainee turns the rod body 7 to perform forearm training, the suspension rope 2 can be stably fitted into the winding groove 3 during winding, avoiding the suspension rope 2 from shifting during training.

As shown in FIG. 1 and FIG. 2, the other end of the suspension rope 2 connected to the connection post 112 of the present embodiment is further provided with a connection clasp 4, and the counterweight can be stably connected to the suspension rope 2 via the connection clasp 4, thereby improving the training strength and safety of the trainee. The connection clasp 4 in the present embodiment includes but is not limited to a spring clasp, a safety clasp or a loop clasp, wherein when the connection clasp 4 is the spring clasp or the safety clasp, the suspension rope 2 can be directly clasped with the counterweight via the spring clasp or the safety clasp, and the connection mode is convenient; when the connection clasp 4 is a loop clasp, the same technical effect can also be obtained by means of the suspension rope 2 passing around the counterweight and passing through the center of the loop clasp to connect the counterweight.

Figure 5:
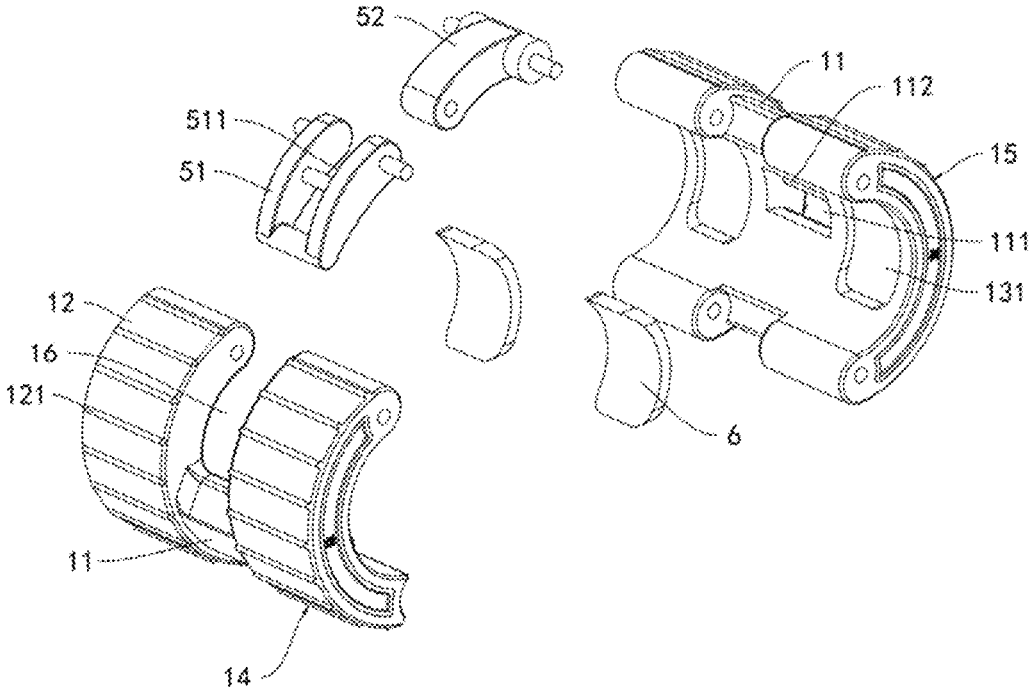
FIG. 5 is an exploded view of an exerciser body of the present embodiment.

As shown in FIG. 1 and FIG. 5, in order to facilitate that the exerciser body 1 of the present embodiment is fixedly mounted on the rod body 7 to assist the trainee in performing forearm training, the exerciser body 1 of the present embodiment is configured as a first body 14 and a second body 15 which are formed by being divided along a plane in which the central axis thereof lies, wherein projection surfaces of the first body 14 and the second body 15 are each formed in a semi-circular ring structure, so that the exerciser body 1 having an inner ring 13 which allows the rod body 7 to pass through can be formed by combining the first body 14 and the second body 15. The exerciser body 1 of the present embodiment can be easily mounted to and dismounted from the rod body 7 by dividing the first body 14 from the second body 15.

Specifically, after the exerciser body 1 of the present embodiment is divided, vertical edges are formed on both sides of the first body 14 and on both sides of the second body 15, wherein one side edge of the first body 14 and one side edge of the second body 15 are hinged to each other, so that the first body 14 and the second body 15 can rotate via a hinged position so as to close and form the exerciser body 1, or rotate via a hinged position so as to dismount the exerciser body 1, so as to facilitate the mounting or dismounting of the exerciser body 1 of the present embodiment on the rod body 7; a pull clasp assembly 5 is connected between the other side edge of the first body 14 and the other side edge of the second body 15 in the present embodiment, and the two ends of the pull clasp assembly 5 are hinged to the first body 14 and the second body 15, respectively, so that the other side edge of the first body 14 and the other side edge of the second body 15 can abut against each other under the pull of the pull clasp assembly 5, thereby being combined to form the exerciser body 1. When the exerciser body 1 of the present embodiment is mounted on the rod body 7 for use, the pull clasp assembly 5 can be opened so as to separate one side edge of the first body 14 and the second body 15, thereby enlarging the inner ring 13 of the exerciser body 1, so as to facilitate the insertion of the rod body 7 into the inner ring 13 of the exerciser body 1; after the rod body 7 is inserted into the inner ring 13, the edge of the first body 14 and the edge of the second body 15 can be brought into close contact with each other by means of the pull clasp assembly 5, so that the inner ring 13 is reduced to lock the rod body 7, thereby completing the stable mounting of the exerciser body 1 according to the present embodiment, and the installation method is convenient and stable, which can improve the safety of the trainee. On the contrary, it is also convenient to dismount the exerciser body 1 from the rod body 7, so that it is easy to dismount and mount.

As shown in FIG. 5, a circular arc-shaped concave portion is formed at an edge where the first body 14 is hinged to the second body 15 in the present embodiment, a connection convex portion is projected from the edge corresponding to the position of the winding portion 11, and a rotary shaft hole is horizontally provided on the connection convex portion; a circular arc-shaped convex portion is formed at an edge of the second body 15 for hinging with the first body 14, and a connecting concave portion is concavely provided at the edge corresponding to the position of the winding portion 11, and a horizontally-provided rotary shaft hole is formed on the circular arc-shaped convex portion. When the first body 14 and the second body 15 of the present embodiment are hinged, the circular arc-shaped convex portion at the edge of the second body 15 can be fitted into the circular arc-shaped concave portion, and the connection convex portion of the first body 14 is fitted into the connection concave portion of the second body 15. At this time, the rotary shaft hole on the connecting convex portion coaxially corresponds to the rotary shaft hole on the circular arc-shaped convex portion. By inserting the connection rotary shaft in the rotary shaft hole, the hinging of the first body 14 and the second body 15 can be realized, and at the same time, the first body 14 and the second body 15 can both be rotated around connection rotary shaft as an axis so as to realize the closing and unfolding of the first body 14 and the second body 15.

As shown in FIG. 3 to FIG. 5, in order to achieve a stable clasp between the first body 14 and the second body 15, so as to improve the locking strength of the exerciser body mounted on the rod body 7, the pull clasp assembly 5 of the present embodiment is provided to include a clasp member 51 and a pull rod member 52 hinged to each other, wherein a clasp opening 511 is provided in the middle of the clasp member 51 of the present embodiment, and one end of the pull rod member 52 is hinged to the middle of the clasp opening 511, so that when the clasp member 51 and the pull rod member 52 are clasped, the front section of the pull rod member 52 can be fitted into the clasp opening 511, thereby shortening the overall length of the clasp assembly. The other end of the clasp member 51 and the pull rod member 52 in the present embodiment is hinged to the edge of the first body 14, and the other end of the pull rod member 52 and the clasp member 51 is hinged to the edge of the second body 15, so that when the clasp assembly is not closed, the edges of the first body 14 and the second body 15 which are not hinged to each other can be separated from each other under the action of the clasp member 51 and the pull rod member 52, thereby enlarging to the inner ring 13 of the exerciser body 1 so as to facilitate mounting on the rod body 7; when the clasp assembly is closed, the clasp member 51 is pressed and pulls the pull rod member 52, and the front end of the pull rod member 52 is fitted into the clasp opening 511 under the action of the hinge, so as to shorten the overall length of the clasp assembly. At this time, the second body 15 can approach the first body 14 under the pull of the pull rod member 52, and then be combined with the first body 14 to form the exerciser body 1, so that the first body 14 and the second body 15 of the present embodiment are closed and locked around the rod body 7 to achieve a stable mounting of the exerciser body 1.

In addition, in order to further improve the stability of the exerciser body according to the present embodiment after being mounted on the rod body 7, the wall surface of the inner ring 13 of the exerciser body according to the present embodiment is further provided with an anti-slip pad 6, and when the first body 14 and the second body 15 are locked on the rod body 7 by being surrounded by the pull clasp assembly 5, the anti-slip pad 6 can fill the gap between the rod body 7 and the inner ring 13, thereby improving the locking strength of the present embodiment; in addition, the anti-slip pad 6 of the present embodiment is made of silicone rubber, and the frictional force with the surface of the rod body 7 is increased, so that mutual rotational slippage between the exerciser body 1 and the rod body 7 can be avoided, and the safety of the exerciser can be improved.

Specifically, the inner ring 13 of the exerciser body 1 according to the present embodiment is provided with a limit mounting groove 131 in the wall surface thereof, and the anti-slip pad 6 can be fitted and mounted in the limit mounting groove 131, so that the mounting strength of the anti-slip pad 6 can be improved, and the locking strength of the exerciser body 1 can be prevented from being affected by the shifting of the anti-slip pad 6. After the anti-slip pad 6 of the present embodiment is mounted in the limit mounting groove 131, the top plane of the anti-slip pad 6 is higher than the wall surface of the inner ring 13 of the exerciser body 1, so that the gap between the rod body 7 and the inner ring 13 can be filled easily, and the locking strength of the present embodiment can be improved. An anti-slip pad 6 is provided on both the inner wall surface of the first body 14 and the inner wall surface of the second body 15 in the present embodiment, which effectively improves the locking strength of the first body 14 and the second body 15 after they are locked.

In addition, as shown in FIG. 4 and FIG. 5, in order to avoid interference of the pull clasp assembly 5 to the winding of the suspension rope 2, the first body 14 or the second body 15 of the present embodiment is further provided with a storage port 16 at a position corresponding to the winding portion 11, and when the clasp member 51 pulls the pull rod member 52 to be clasped, the clasp member 51 and the pull rod member 52 can be fitted into the storage port 16 so as to be at the same height as the winding portion 11, thereby facilitating stable winding of the suspension rope 2 during training of a trainee.

In summary, in the present embodiment, by providing the exerciser body 1 with a cylindrical structure and an inner ring 13 at the central axis, and providing the winding portion 11 connected to the suspension rope 2 in the middle of the circumferential direction of the exerciser body 1, the exerciser body 1 can be fixed on the rod body 7 via the inner ring 13 when the trainee trains the forearm, so that slipping can be avoided when the trainee grips the rod body 7 to rotate for winding up the suspension rope 2, and the training effect of the forearm can be ensured; and the suspension rope 2 can be stably wound on the winding portion 11 in the middle of the circumference of the exerciser body 1 during the winding process, so that the suspension rope 2 can be prevented from shifting when being wound, thereby avoiding the deviation of the exercise intensity of the two arms and causing strain; in addition, the present embodiment provides a grip portion 12 on both sides of the winding portion 11, so that both hands of the trainee can rotate the winding weight by gripping on the grip portion 12 to carry out the training of the wrist strength, and also prevents slipping from causing a safety hazard, ensuring the safety training of the trainee.

The embodiments described above are only preferred embodiments of the present invention and should not be used to limit the scope of the present invention, and any insubstantial changes and modifications made by those skilled in the art on the basis of the present invention fall within the scope of the present invention.

The invention claimed is:

1. A forearm exerciser, comprising an exerciser body (1), wherein the exerciser body (1) is of a cylindrical structure and comprises a winding portion (11) circumferentially arranged in the middle of the exerciser body (1) and grip portions (12) symmetrically arranged at both ends of the winding portion (11) for gripping during exercise, a suspension rope (2) for suspending a weight is connected to the winding portion (11), and an inner ring (13) for allowing a rod body (7) to pass through is formed at a central axis of the exerciser body (1);

wherein the exerciser body (1) is divided into a first body (14) and a second body (15) formed in a semi-circular structure along a plane of its central axis, one side edge of the first body (14) and one side edge of the second body (15) are hinged to each other, and a pull clasp assembly (5) is connected between other side edge of the first body (14) and other side edge of the second body (15).

2. The forearm exerciser according to claim 1, wherein an outer diameter of the winding portion (11) is smaller than an outer diameter of the grip portion (12) and sinks to form a winding groove (3) for winding the suspension rope (2).

3. The forearm exerciser according to claim 1, wherein the winding portion (11) is provided with a connection port (111) where a connection post (112) arranged in a width direction of the winding portion (11) is mounted, and an end of the suspension rope (2) is connected to the connection post (112).

4. The forearm exerciser according to claim 3, wherein the other end of the suspension rope (2) connected to the connection post (112) is provided with a connection clasp (4) for clasping to a hook for exercising.

5. The forearm exerciser according to claim 1, wherein a width of the grip portion (12) is greater than a width of the winding portion (11), and a surface of the grip portion (12) is provided with an anti-slip pattern (121).

6. The forearm exerciser according to claim 1, wherein the pull clasp assembly (5) comprises a clasp member (51) hinged to an edge of the first body (14) and a pull rod member (52) hinged to an edge of the second body (15), the clasp member (51) is provided with a clasp opening (511), the other end of the pull rod member (52) hinged to the second body (15) being hinged in the clasp opening, wherein the first body (14) and the second body (15) are closed around the rod body (7) when the clasp member (51) is pressed to pull the pull rod member (52).

7. The forearm exerciser according to claim 1, wherein the first body (14) or the second body (15) is provided with a storage port (16) for receiving the pull clasp assembly (5) at a position corresponding to the winding portion (11).

8. The forearm exerciser according to claim 1, wherein a wall surface of an inner ring (13) of the exerciser body (1) is provided with an anti-slip pad (6).

9. The forearm exerciser according to claim 8, wherein a wall surface of the inner ring (13) of the exerciser body (1) is provided with a limit mounting groove (131), the anti-slip pad (6) is embedded in the limit mounting groove (131), and a top of the anti-slip pad (6) is higher than the wall surface of the inner ring (13) of the exerciser body (1).

* * * * *